United States Patent [19]

Wild

[11] 4,206,941

[45] Jun. 10, 1980

[54] UNIVERSAL BOTTLE SUSPENSION DEVICE

[76] Inventor: Anton J. Wild, 310 Springfield Ave., Westfield, N.J. 07091

[21] Appl. No.: 956,772

[22] Filed: Nov. 1, 1978

[51] Int. Cl.[2] ..... B66C 1/42

[52] U.S. Cl. ..... 294/87.26

[58] Field of Search ..... 294/87.2, 87.22, 87.24, 294/87.26; 414/750, 751; 198/695

[56] References Cited

U.S. PATENT DOCUMENTS

| | | | |
|---|---|---|---|
| 3,186,751 | 6/1965 | Dardaine | 294/87.26 |
| 4,089,203 | 5/1978 | Wallis | 414/751 |

FOREIGN PATENT DOCUMENTS

| | | | |
|---|---|---|---|
| 84441 | 2/1957 | Netherlands | 294/87.26 |

*Primary Examiner*—James B. Marbert

*Attorney, Agent, or Firm*—John J. Kane; Frederick A. Zoda; Albert Sperry

[57] ABSTRACT

A Universal Bottle Suspension Device for packers including a plurality of movably mounted slide members which are arranged in rows and are disposed in spaced relation with respect to one another in order to be movable both toward and away from one another, each movable slide member including a downwardly extending connector means and a rail member secured to the bottom of the connector means, each rail member generally extending parallel with respect to the slide members such that the rail members are adapted to be movable both toward and away from one another in such a fashion as to hold and release bottles wherein the head of the bottle extends above the rail members and the rail members are adapted to be urged against the neck area of the bottle, the inwardly facing edges of the rail member providing low friction surfaces to facilitate movement of the bottle when held between the rail members, the friction free surfaces thereby defining a retaining channel therebetween for selectively holding the bottles therein, the slide members being movably mounted upon a fixedly positioned pivot shaft and upon two axially movably shafts laterally from the central shaft defined as a first shaft and a second shaft, the first and second shaft each being secured to opposite ends of a pivotally mounted pivot link means such that the movement of the first shaft in an axial direction will cause movement of the second shaft in the opposite axial direction, one of each pair of slide members being fixedly secured to the first shaft and movably secured to the second shaft and the other one of each pair of slide members being fixedly secured to the second shaft and slidably secured to the first shaft such that axial movement of the first shaft toward the pivot link will cause closing of the rail members into the retaining channel whereas axial movement of the first shaft away from the pivot link will cause each pair of rail members to separate and thereby release bottles held therein.

11 Claims, 5 Drawing Figures

UNIVERSAL BOTTLE SUSPENSION DEVICE

BACKGROUND OF THE INVENTION

1. Field of the Invention

The present invention provides a device or mechanism for handling of bottles in an orderly arrangement regardless of the shape and size of the bottles and is particularly usable with currently designed bottles having irregular base configurations. The Universal Bottle Suspension Device of the present invention is particularly usable with bottle packers however it can also be used with apparatus designed for un-packing bottles and a variety of other types of usages wherein a universal bottle suspension system is desirable.

A device or mechanisms for suspending bottles of this type is particularly desirable for equipping packers wherein articles of the general types set forth herein are handled automatically. The universal device of the present apparatus is particularly usable to either encase articles or on the other hand to uncase them.

In the situation where articles are fed from a bottle conveyor to fill empty cases or where the bottles are fed from full cases to a conveyor, the bottles are generally disposed in parallel rows and as such the present bottle suspension device is particularly usable. Also to promote fast handling without breakage this device or mechanism is capable of suspending several rows of bottles with each stroke of movement of the machinery.

2. Description of the Prior Art

The following patents have been found to be somewhat pertinent with respect to the present invention.

| PATENTS | PATENTEE |
|---|---|
| 2,899,233 | J.C. Cella et al |
| 3,174,791 | E.J.M. Dardaine |
| 3,186,751 | E.J.M. Dardaine |
| 3,754,667 | R.H. Storch |
| 2,431,310 | B.C. Coons |
| 2,730,279 | A.G. Enock |
| 3,065,988 | J.E. Driscoll |
| 2,823,946 | G.J. Okulitch et al |
| 3,077,259 | C.K. Braun |
| 3,244,303 | D.J. Conner |
| 3,886,891 | D.F. Hardy |
| 3,765,712 | D.F. Hardy et al |
| 3,521,760 | B.J. Wallis |

These patents disclose the various bottle gripping means usable for packing and unpacking bottles within cases and other orienting receiving means.

A problem has been found to exist with these designs since they assume that the base of the bottle is of generally a flat configuration. The newer bottle design include bases having many various configurations other than flat and as such the bottle does not often set easily upon a bottom narrow rail or the like which have proved useful heretofore. Therefore the present invention provides a universal means of suspending the bottles from above and thereby eliminates the requirement of prior art structures of handling bottles with only flat base areas.

SUMMARY OF THE INVENTION

The universal bottle suspension device of the present invention provides a plurality of movably mounted slide members which are arranged in pairs and disposed in spaced relation with respect to one another to be movable both toward and away from one another. Each pair of the slide members will include a first slide member and a second slide member and each individual slide member will define therein a central slide aperture and two lateral slide apertures further defined as a first lateral slide aperture and a second lateral slide aperture. The first and second slide apertures are located on each lateral side of the central slide aperture such that three regularly spaced apertures will be defined within each movably mounted slide member.

The bottle suspension device further includes a connector extending downwardly below each slide member and as such is movable both toward and away from one another simultaneously with movement of the movably mounted slide members toward and away from one another. Each downwardly extending connector will include a rail member fixedly secured to the bottom thereof which extends longitudinally with respect to the slide member. As such, the first slide member will include a first connector extending downwardly therefrom and a first rail means extending longitudinally with respect thereto. Similarly a second slide member, connector and rail member will be configured.

The first rail member and the second rail member will therefore extend generally parallel with respect to one another and will be movable both toward and away from one another simultaneously with similar movement of the first and second slide members. Each rail member will thereby be adapted to selectively be urged in abutment with the neck area of a bottle to suspend the bottle for packing, unpacking or other desired movement. To facilitate movement of the bottles through the retaining channel defined between the rail members, the inwardly facing surfaces of the rail members will preferably include low friction surfaces and possibly a downwardly extending front surface to facilitate movement of the bottles up into position in the retaining channel.

A plurality of support members will be fixedly secured to the surrounding environmental structure. Each support member will define a central support aperture and two lateral support apertures therein. The two lateral support apertures will be defined as a first lateral support aperture and a second lateral support aperture. The support members will be oriented with respect to the pairs or movably mounted slide members such that all of the first lateral slide apertures of the movably slide members and the first lateral support apertures of the support members will be axially oriented with respect to one another such that they mutually register with respect to one another.

Similarly the second lateral slide apertures of the slide members and the second lateral support apertures of the support members will be axially oriented.

A pivot shaft will be fixedly secured to the support members and will extend through the central slide apertures such that the central slide apertures are movable with respect thereto. The device of the present invention also includes a first shaft which is adapted to extend through the first lateral support apertures of the support members to be movable with respect thereto. The first shaft means also extends through the first lateral slide apertures of the slide members in such a manner as to be horizontally parallel with respect to the pivot shaft. The first shaft is preferably perpendicular with respect to the support to the support members and the slide members.

Similarly a second shaft is positioned extending through the second lateral support aperture of the support apertures such as to be movable with respect thereto. Also the second shaft extends through the second slide apertures of the slide members to be horizontally parallel with respect to the first shaft and with respect to the pivot shaft.

Each of these shafts is connected to a pivot link which is pivotally positioned at one end of the present device. The first and second shafts are connected at opposite ends of the pivot axis such that pivoting of the pivot link will cause axial movement of the first and second shafts in opposite directions with respect to one another.

Each of the first slide means is fixedly secured to the first shaft means by a set screw means or the like protruding through the first lateral slide apertures. Similarly, each of the second slide means is fixedly secured to the second shaft by a set screw means or the like protruding through the second lateral slide aperture. In this manner pivotal movement of the pivot link will cause opposite axial movement of the first and second shafts with respect to one another and consequently will cause selectively closing or widening of the distance between each pair of said first and second rail members. In this manner a means of holding the bottles and a means of releasing the bottles selectively merely by pivoting of the pivot link will be achievable.

It is an object of the present invention to provide a universal bottle suspension device which is usable for handling bottles in an orderly arrangement regardless of the shapes and sizes of the bottles.

The present invention provides a means for universally suspending bottles for packers, unpackers and other various applications such as to be usable with a wide range of different bottleneck designs.

It is an object of the present invention to provide a universal bottle suspension device for aligning and suspending bottles and other similarly shaped articles.

It is an object of the present invention to provide a universal bottle suspension device usable with packers as well as unpackers and other article handling devices.

It is an object of the present invention to provide a universal bottle suspension device having the characteristics of fast handling and minimal breakage of handled articles.

It is an object of the present invention to provide a universal bottle suspension device which is capable of suspending several rows of articles per stroke.

It is an object of the present invention to provide a bottle suspension device including bottle suspending rails which can accomodate a variety of bottlenecks merely by modifying the registering edges of the rails with grooves, teeth, etc.

BRIEF DESCRIPTION OF THE DRAWINGS

While the invention is particularly pointed out and distinctly claimed in the concluding portions herein, a preferred embodiment is set forth in the following detailed description whch may be best understood when read in connection with the accompanying drawings, in which:

DETAILED DESCRIPTION OF THE PREFERRED EMBODIMENT

Figure 1:
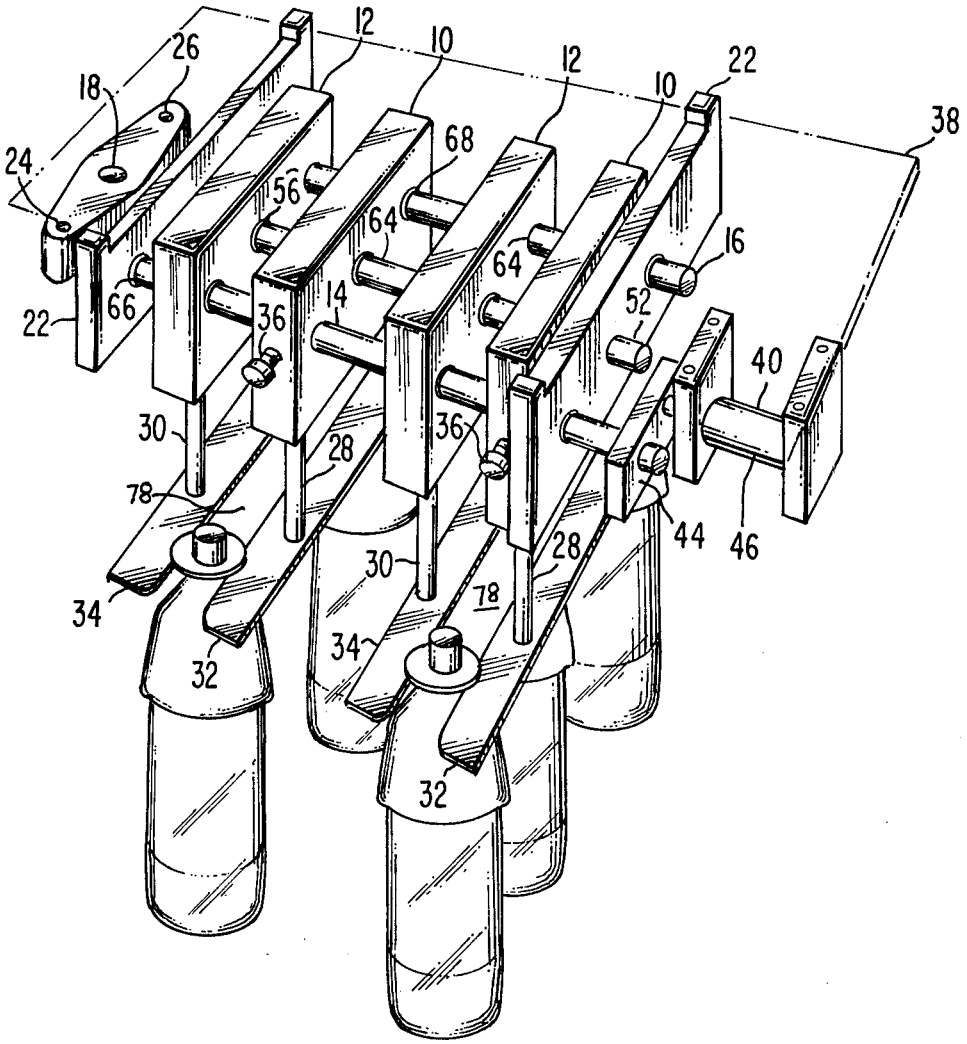
FIG. 1 is a perspective view of an embodiment of the universal bottle suspension device of the present invention.

The present invention includes a plurality of pairs of slide members such as first slide members 10 and second slide members 12. Each first slide member 10 is grouped in a pair with a second slide member 12 and are disposed in spaced relation with respect to one another to be movable both toward and away from one another.

Each first slide member 10 is fixedly secured to a first connector means 28 extending downwardly therefrom. Similarly, each second slide member 12 is fixedly connected to a second connector means 30 extending downwardly therefrom. A first rail member 32 is secured to the first connector means 28 at the lower end thereof. Similarly a second rail member 34 is fixedly secured to the bottom end of each second connector means 30. The first and second rail members extend longitudinally parallel to the longitudinal direction of the slide members 10 and 12. As such, the first rail members 32 and the second rail members 34 are adapted to selectively move both toward and away from one another in order to hold or release bottles therebetween. The rail members 32 and 34 define a retaining channel 78 therebetween which may be widened to release the bottles by movement of the rail members away from one another. On the other hand, the retaining channel 78 can be narrowed by movement of the first and second rail members toward one another. This opening and closing movement of the rail members 32 and 34 is caused by similar movement of the first and second slide members 10 and 12.

The proper coordinated movement of the first and second slide members 10 and 12 is controlled by the operating configuration of the universal bottle suspension device of the present invention. This configuration includes a first shaft means 14 and a second shhaft means 16. Each of the shaft means 14 and 16 extend through apertures in the slide members 10 and 12. In particular, each slide member defines a central slide aperture 64 as well as a first lateral slide aperture 66 and a second lateral slide aperture 68. In other words each slide member 10 and 12 includes three apertures therein. The aperture 64 is centrally located and the lateral aperture 66 and 68 are positioned on opposite sides thereof.

All of the first lateral slide apertures 66 of the first and second slide members 10 and 12 are axially oriented and registered such that the first shaft means 14 protrudes axially therethrough. Similarly all of the second lateral slide apertures 68 of the first and second slide members 10 and 12 are axially oriented or registered such that the second shaft means 16 may extend therethrough.

To provide supporting structure the device of the present invention includes a plurality of support members 22 fixedly secured to the surrounding environmental structure. Each support member 22 includes a central support aperture 58 as well as a first lateral support aperture 60 and a second lateral support aperture 62. Each of the first lateral support aperture 60 is axially collimated with the first lateral slide apertures 66 such that the first shaft means 14 extends therethrough. Similarly all of the second lateral support apertures 62 are axially collimated with the second lateral slide apertures 68 such that the second shaft means 16 extends axially therethrough. In this manner all of the first lateral apertures of the slide members and support members will be collimated such that the first shaft extends therethrough. Similarly, all of the second lateral apertures of the slide members and support members will be oriented or collimated such that the second shaft means 16 extends therethrough.

Figure 2:
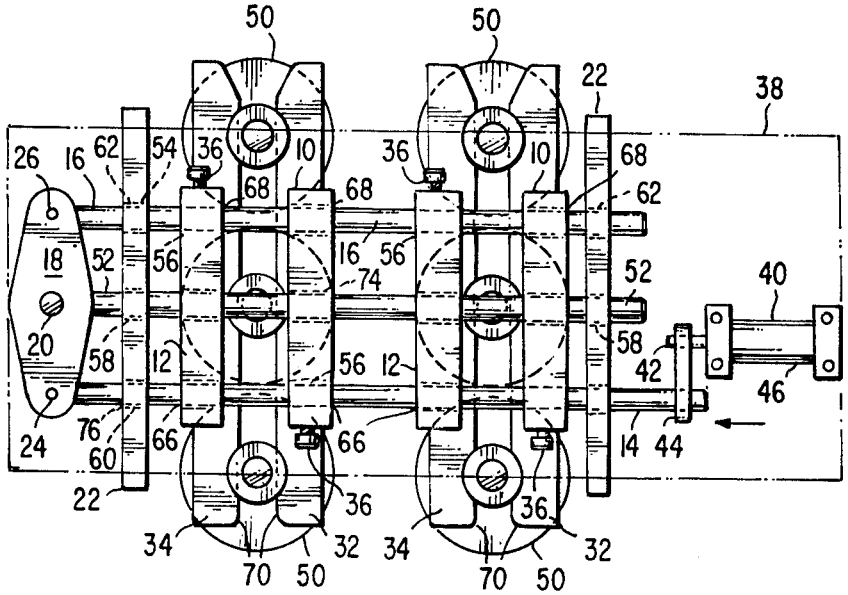
FIG. 2 is a top plan view of an embodiment of the universal bottle suspension device of the present invention shown in the closed position.
Figure 3:
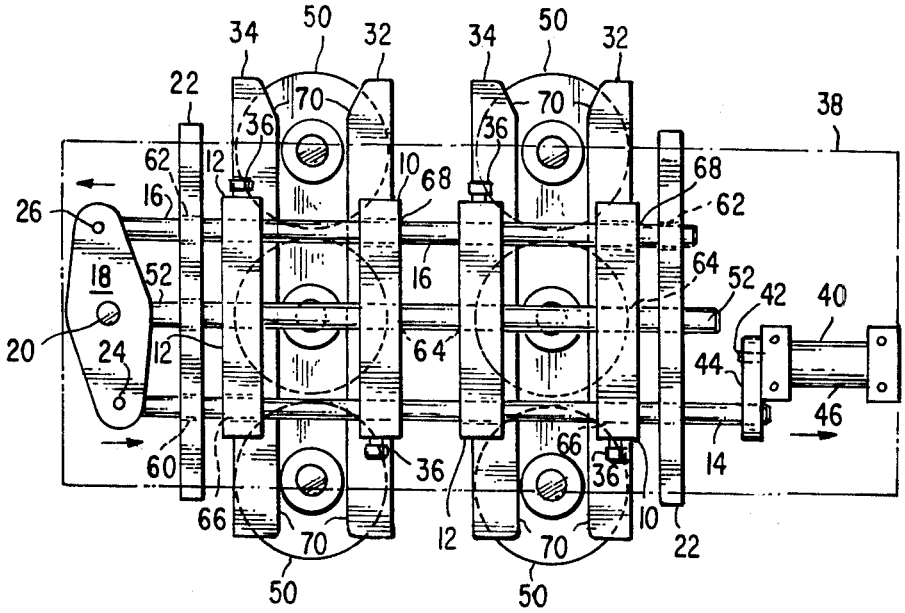
FIG. 3 is a top plan view of the embodiment shown in FIG. 2 in the opened position.
Figure 4:
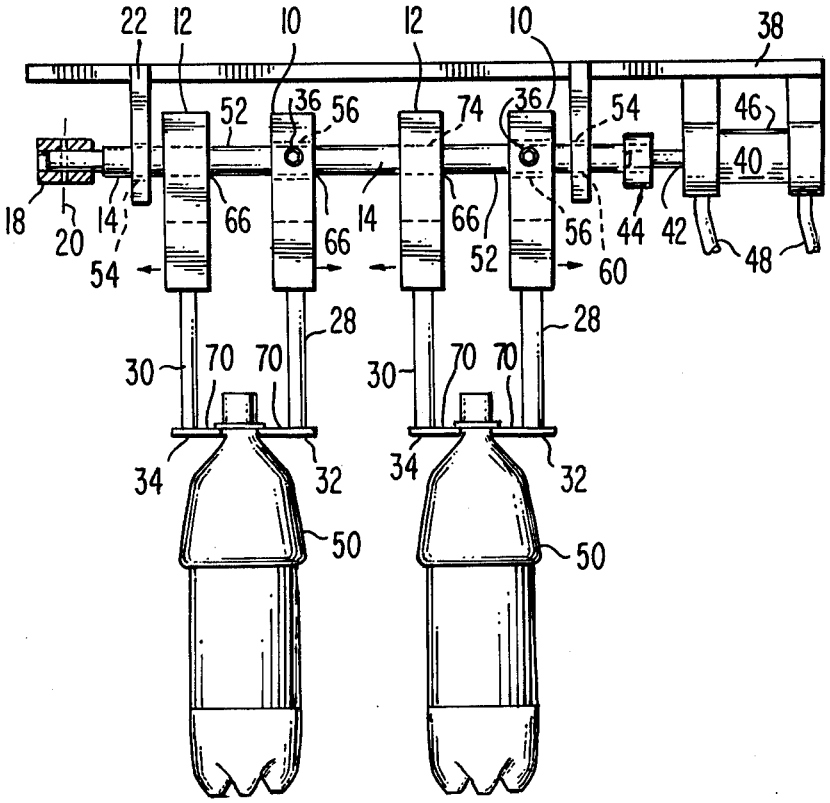
FIG. 4 is a front elevation of an embodiment of the universal bottle suspension device of the present invention shown in the closed position.

One of the shaft means 14 or 16 must be fixedly connected to an actuator means 40 in order to control the axial movement thereof. In the figures of the present drawing the first shaft means 14 is shown connected to the actuator means 40 through an actuator bracket 44 which directly connects the actuator piston 42 with the first shaft means 14. Preferably the actuator means 40 will take the form of an air cylinder 46 with a plurality of air hoses 48 extending therefrom such that the selective exposure of the air hoses to pressurized pneumatic sources will cause movement of the actuator piston 42. Such movement will cause the first shaft means to travel to the left as shown in FIG. 2.

The opposite end of the first shaft means is connected to a pivot link means 18 which is pivotally mounted at a pivot link axis 20. Both of the first shaft means 14 and the second shaft means 16 are connected to the pivot link means 18 at opposite locations such that the pivot link axis 20 is between the two points of attachment. The first and second shaft means are pivotally connected to the opposite points of the pivot link means 18. In particular the first shaft means is connected to the pivot link means at the first shaft-to-link axis 24. Similarly the second shaft is connected to the pivot link means 18 at the second shaft-to-link axis 26. In this manner movement of the actuator means 40 will cause movement to the left as shown in FIG. 2 of the first shaft means causing clockwise rotation of the pivot link means 18 and resulting in movement of the second shaft means 16 to the right. In order to allow this pivotal movement of the shaft means 14 and 16 to accurately control the opening and closing of the rail members 32 and 34 a plurality of set screws 36 are utilized.

Each of the first slide members 10 is fixedly secured to the first shaft means 14 by the set screw means 36. Similarly each of the second slide members 12 is fixedly secured by the set screw means 36 to the second shaft means 16. On the other hand, the first shaft means 14 is axially movable with respect to all of the second slide members 12 and the second shaft means 16 is axially movable with respect to all of the first slide members 10.

A mounting plate 38 is fixedly secured to the surrounding environmental structure and each of the support members 22 is preferably fixedly mounted to the mounting plate 38. Also each of the support members 22 is fixedly secured to a pivot shaft member 52 which extends axially through each of the central support apertures 58 and is fixedly secured to the support members 22 by set screws or other means of securement. The central support apertures 58 are collimated with the central slide apertures 64 such that the pivot shaft member 52 extends through all these apertures; however, the pivot shaft member 52 is fixedly connected only to the support members 22. The central slide apertures 64 preferably include bearing means 56 therein to facilitate axially slidable engagement between the slide members 10 and 12 and the pivot shaft member 52. Similarly each of the support members 22 include support bearings 54 in the first and second lateral support apertures thereof to facilitate slidable engagement between the first and second shaft means 14 and 16 and the support members 22.

Figure 5:
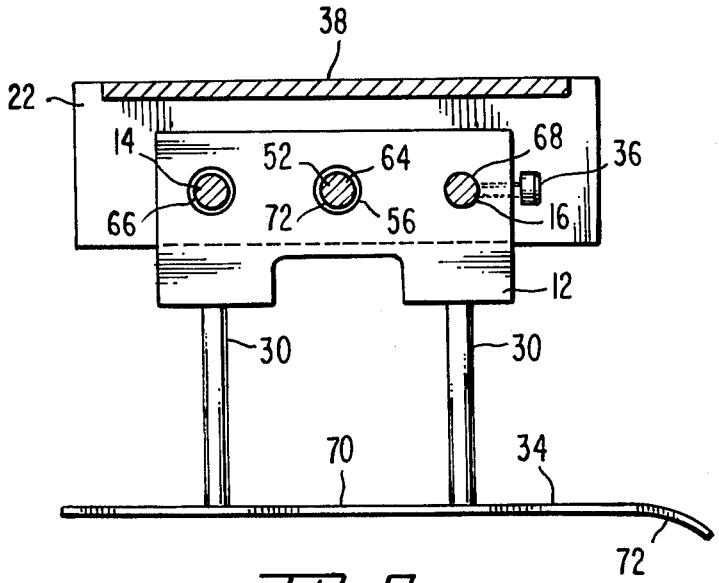
FIG. 5 is an end view of an embodiment of the slide member and rail member configuration of the present invention shown in place.

To facilitate suspending of the bottles 50 within the retaining channel 78 the inwardly facing surfaces of the rail members 32 and 34 may include low friction surfaces 70 to allow the bottles 50 to be slid therealong. Also as best shown on FIG. 5 the end of the rail members 32 and 34 can include a downwardly inclined surface 74 to facilitate the upward movement of bottles 50 into suspended position within the retaining channel 78. The bearing means 74 and 76 of the slide members 10 and 12 and the support members 22 can be of any chosen bearing configuration to facilitate slidable axial movement between the shafts 14 and 16 and the apertures of the slide members and the support members.

In operation bottles 50 may be positioned in suspension within the retaining channel 78. If it is desirable at this point to drop the bottles in their orientation into a pre-selected location the operator will initiate movement of the actuator means 40 by placing the desired pneumatic pressure through the hoses 48. This operation will cause a retracting of the actuator piston 42 and a movement of the first shaft means as shown in FIG. 2 in the right direction. Such movement will cause counter-clockwise rotation of the pivot link means 18 and a resulting movement to the left of the second shaft means 16. By such movement the bottle suspension device will open. This opening is caused since the movement to the right of the first shaft means 14 will cause similar movement to the right of all of the first slide members 10 and first rail members 32. Similarly, movement to the left of the second shaft means 16 will cause movement to the left for all of the second slide members 12 and the second rail members 34. Therefore each pair of rail members 32 and 34 will move away from one another such that the bottles will be released and dropped therebelow.

At this point it will be desirable to reclose the first and second rail members 32 and 34 to be in a bottle receiving position. In order to cause this movement the actuator means will be again activated and the piston 42 will travel outwardly from the actuator means and cause the first shaft means to move to the left. This will cause clockwise rotation of the pivot link 18 and movement in the right direction of the second shaft means 16. As a result all of the first slide members 10 and first rail means 32 will move to the left and all of the second slide members 12 and the second rail members 34 will move to the right. In this manner each pair of rail members 32 and 34 will move toward one another and close in order to redefine the retaining channel 78 in an orientation adaptable to receive bottles 50 therebetween.

Axial movement and proper collimation will be achieved by the perpendicular relationship between the slide members and support members with respect to the pivot shaft member 52 and the first and second shaft means at 14 and 16. Further proper orientation will be achieved by the location of the pivot shaft member 52 extending axially through all of the central slide apertures 64 and the central support apertures 58. As a result a smooth and efficiently operating bottle suspension device is shown which can be usable with a variety of different sizes and shapes of bottles. It should also be appreciated that the inwardly directed surfaces of the rail members 32 and 34 could be of any configuration including jaws, teeth, etc. in order to facilitate the suspending of the bottles however for convenience of the present invention they have been shown as straight surfaces which preferably have a low friction characteristic.

While particular embodiments of this invention have been shown in the drawings and described above, it will be apparent, that many changes may be made in the form, arrangement and positioning of the various elements of the combination. In consideration thereof it should be understood that preferred embodiments of this invention disclosed herein are intended to be illustrative only and not intended to limit the scope of the invention.

What is claimed is:

1. A Universal Bottle Suspension Device comprising:

(a) a plurality of movably mounted slide members arranged in pairs and disposed in spaced relation with respect to one another to be movable both toward and away from one another, each pair of said slide members comprising a first slide member and a second slide member, each slide member defining therein a central slide aperture, and two lateral slide apertures, a first lateral slide aperture and a second lateral slide aperture, each being located on each lateral side of said central slide aperture;

(b) a first connector means extending downwardly below each said first slide member and a second connector means extending downwardly below said second slide member, said first and second connector means being movable responsive to movement of said first and second slide members;

(c) a first rail member fixedly secured to said first connector means and extending longitudinally with respect to said first slide member, a second rail member fixedly secured to said second connector means and extending longitudinally with respect to second rail member, said first rail member and said second rail member being disposed in spaced relationship and parallel with respect to one another to define a retaining channel there between for holding and suspending bottles, said first and second rail member being movable both toward and away from one another responsive to similar movement of said first and second movably mounted slide members;

(d) a plurality of support members being fixedly secured to the surrounding environmental structure and positioned adjacent said slide members, each support member defining a central support aperture, and two lateral support apertures, a first lateral support aperture and a second lateral support aperture each being located on each lateral side of said central support aperture;

(e) a pivot shaft extending through said central support apertures and fixedly secured thereto, said pivot shaft also extending through said central slide apertures and movable with respect thereto;

(f) a first shaft means extending through said first lateral support apertures of said support members and being movable with respect thereto, said first shaft means also extending through said first lateral slide apertures of said slide members to be horizontally parallel with repect to said pivot shaft;

(g) a second shaft means extending through said second lateral support apertures of said support members and being movable with respect thereto, said second shaft means also extending through said second slide apertures of said slide members to be horizontally parallel with respect to said first shaft means and said pivot shaft means;

(h) a pivot link means being pivotally secured at opposite ends thereof to said first shaft means and second shaft means, said pivot link being pivotally secured at the central area thereof to the surrounding environmental structure such that axial movement of said first shaft means will cause pivoting of said pivot means and opposite axial movement of said second shaft means, each said first slide member being fixedly secured to said first shaft means at said first lateral slide aperture and each of said second slide members being fixedly secured to said second shaft means at said second lateral slide apertures such that pivotal movement of said pivot link and axial movement of said first and second shaft means causes closing and widening of the distance between each pair of said first and second rail members.

2. The device as defined in claim 1 further including set screw means to provide the means of fixedly securing said first slide member to said first shaft means and to provide the means of fixedly securing said second slide member to said second shaft means.

3. The device as defined in claim 1 wherein said pivot shaft, said first shaft means and said second shaft means are oriented perpendicular with respect to said support members and said first and second slide members.

4. The device as defined in claim 1 further including an actuator means fixedly secured to one of said first and second shaft means to cause axial movement thereof and the closing and separating of the distance between each pair of said rail members.

5. The device as defined in claim 4 wherein said actuator is an air cylinder.

6. The device as defined in claim 5 wherein said air cylinder includes an axially movable piston means fixedly linked to one of said first and second shaft means.

7. The device as defined in claim 1 wherein said first and second rail means include low friction surfaces to facilitate the movement of bottles therebetween without breakage.

8. The device as defined in claim 1 wherein one end of said first and second rail means includes a downwardly inclined section to facilitate the flow of bottles into position between said first and second rail members.

9. The device as defined in claim 1 wherein said first and second slide members include bearing means in said central slide apertures to facilitate slidable movement of said first and second slide members with respect to said pivot shaft.

10. The device as defined in claim 1 wherein said support members include bearing means located within the first and second lateral support apertures to facilitate movement of said first and second shaft means with respect to said support member.

11. A Universal Bottle Suspension Device comprising:

(a) a plurality of movably mounted slide members arranged in pairs and disposed in spaced relation with respect to one another to be movable both toward and away from one another, each pair of said slide members comprising a first slide member and a second slide member, each slide member defining therein a central slide aperture, and two lateral slide apertures, a first lateral slide aperture and a second lateral slide aperture, each being located on each lateral side of said central slide aperature:

(b) a first connector means extending downwardly below each said first slide member and a second connector means extending downwardly below said second slide member, said first and second connector means being movable responsive to movement of said first and second slide members:

(c) a first rail member fixedly secured to said first connector means and extending longitudinally with respect to said first slide member, a second rail member fixedly secured to said second connector means and extending longitudinally with respect to said second rail member, said first rail member and said second rail member being disposed in spaced relationship and parallel with respect to one another to define a retaining channel therebetween for holding and suspending bottles, said first and second member being movable both toward and away from one another responsive to similar movement of said first and second movably mounted slide members;

(d) a plurality of support members being fixedly secured to the surrounding environmental structure and positioned adjacent said slide members, each support member defining a first lateral support aperture and a second lateral support aperture each being located on each lateral side of said central support apertures;

(e) a pivot shaft extending through said central support aperture and fixedly secured thereto, said pivot shaft also extending through said central slide apertures and movable with respect thereto;

(f) a first shaft means extending through said first lateral support apertures of said support members and being movable with respect thereto, said first shaft means also extending through said first lateral slide apertures of said slide members to be horizontally parallel with respect to said pivot shaft, said first shaft means being perpendicular with respect to said support members and said slide members;

(g) a second shaft means extending through said second lateral support apertures of said support members and being movable with respect thereto, said second shaft means also extending through said second slide apertures of said slide members to be horizontally parallel with respect to said first shaft means and said pivot shaft means, said second shaft means being perpendicular with respect to said support members and said slide members;

(h) a pivot link means being pivotally secured at opposite ends thereof to said first shaft means and said second shaft means, said pivot link being pivotally secured at the central area thereof to the surrounding environmental structure such that axial movement of said first shaft means will cause pivoting of said pivot means and opposite axial movement of said second shaft means each said first slide member being fixedly secured to said first shaft means at said first lateral slide aperture by set screw means, and each of said second slide members being fixedly secured to said second shaft means at said second lateral slide aperture by set screw means such that pivotal movement of said pivot link and axial movement of said first and second shaft means causes closing and widening of the distance between each pair of said first and second rail members;

(i) actuator means fixedly secured to one end of said first and second shaft means to cause axial movement thereof and the closing and separating of the distance between each pair of said rail members.

* * * * *